US011332865B2

(12) United States Patent
Miyamae et al.

(10) Patent No.: US 11,332,865 B2
(45) Date of Patent: May 17, 2022

(54) METHOD OF PRODUCING A PROCESSED MATERIAL

(71) Applicant: KABUSHIKI KAISHA MIYAKE DESIGN JIMUSHO, Tokyo (JP)

(72) Inventors: Yoshiyuki Miyamae, Tokyo (JP); Manabu Nakatani, Tokyo (JP); Nanae Tera, Tokyo (JP); Mika Kamakura, Tokyo (JP)

(73) Assignee: KABUSHIKI KAISHA MIYAKE DESIGN JIMUSHO, Tokyo (JP)

( * ) Notice: Subject to any disclaimer, the term of this patent is extended or adjusted under 35 U.S.C. 154(b) by 0 days.

(21) Appl. No.: 16/781,162

(22) Filed: Feb. 4, 2020

(65) Prior Publication Data

US 2020/0277717 A1 Sep. 3, 2020

(30) Foreign Application Priority Data

Feb. 28, 2019 (JP) ..... JP2019-036156

(51) Int. Cl.

| | |
|---|---|
| ***D06B 21/00*** | (2006.01) |
| ***D06B 19/00*** | (2006.01) |
| ***D06B 1/04*** | (2006.01) |
| ***B05D 3/00*** | (2006.01) |
| ***B05D 1/38*** | (2006.01) |
| ***B05D 3/12*** | (2006.01) |
| ***B05D 1/00*** | (2006.01) |

(52) U.S. Cl.

CPC ..... *D06B 21/00* (2013.01); *B05D 1/00* (2013.01); *B05D 1/38* (2013.01); *B05D 3/007* (2013.01); *B05D 3/12* (2013.01); *D06B 1/04* (2013.01); *D06B 19/0005* (2013.01)

(58) Field of Classification Search

CPC ..... D06B 21/00; D06B 1/0005; B05D 1/38; B05D 3/007

See application file for complete search history.

(56) References Cited

U.S. PATENT DOCUMENTS

| | | | | |
|---|---|---|---|---|
| 3,556,361 A * | 1/1971 | O'Boyle | ..... | D06F 71/295 223/73 |
| 3,922,410 A * | 11/1975 | Halloran | ..... | B05D 1/16 427/206 |
| 6,214,417 B1 * | 4/2001 | Watanabe | ..... | D06P 1/5257 427/389.9 |
| 2004/0041894 A1 * | 3/2004 | Martin | ..... | B41J 2/0057 347/103 |

FOREIGN PATENT DOCUMENTS

| | | | |
|---|---|---|---|
| JP | 2006-70365 A | | 3/2006 |
| JP | 2006070365 A | * | 3/2006 |

* cited by examiner

*Primary Examiner* — Dah-Wei D. Yuan
*Assistant Examiner* — Kristen A Dagenais-Englehart
(74) *Attorney, Agent, or Firm* — WHDA, LLP

(57) ABSTRACT

To provide a method of producing a processed cloth capable of forming various concave-convex patterns on a cloth material in a simple manner. A method of producing a processed cloth comprising the steps of: preparing a cloth; printing a first sizing agent containing a foaming agent on at least a portion of the cloth material; and pressing the printed cloth with a heated metal plate to foam the foaming agent. The method of producing a processed cloth may further include a step of printing a second sizing agent containing a coloring agent on the cloth material. The method of producing the processed cloth may further include a step of sublimation transfer to the cloth material.

4 Claims, 9 Drawing Sheets

Application of sizing agent containing foaming agent

Application of sizing agent containing pigment

Foaming and coloring by heating

Washing

Application of sizing agemt containing pigment

Application of sizing agent containing foaming agent

Foaming and coloring by heating

Washing

Application of sizing agent containing foaming agent

Pressing together with transfer paper

Foaming and coloring

Washing

Application of sizing agent containing foaming agent

Foaming by heating

Washing

Sublimation transfer

Coloring

METHOD OF PRODUCING A PROCESSED MATERIAL

TECHNICAL FIELD

The present invention relates to a method of producing a processed material such as clothes, and more particularly to a method of producing a processed material including folded portions or pleats.

BACKGROUND OF THE INVENTION

For example, a method of producing a pleated fabric, including the following steps, is known: (1) a step of printing a foam material ink and a fixing ink on a shrink film; (2) a step of heating both a raw material cloth and the shrink film while the foam material ink on the shrink film is in contact with the back side of the raw material cloth; (3) a step of shrinking the shrink film and foaming the foam material ink while adjusting the pressure of a thermal press plate so as to obtain a pleated fabric having bottle pleat portions and fine pleat portions; and (4) a step of removing the shrink film and the foamed foam material ink from the pleated fabric (for example, Patent Document 1).

RELATED-ART DOCUMENTS

Patent Document

[Patent Document 1] Japanese Unexamined Patent Application Publication No. 2006-70365

SUMMARY OF THE INVENTION

Problem to be Solved by the Invention

However, the above-mentioned method of producing the pleated fabric, in which the shrink film is used, has a limitation in the expression of the pleats. Further, it is troublesome to reliably remove the shrink film from the fabric. Thus, the conventional method of producing a pleated cloth still has a room for improvement.

It is therefore an object of the present invention to provide a method of producing a processed cloth capable of forming various concave-convex patterns on a raw material by means of a simple manner.

Means to Solve the Problems

In order to solve the above-mentioned problems, the present invention provides a method for producing a processed cloth, which includes the steps of: preparing a cloth material, applying (printing) a first sizing agent containing a foaming agent on at least a portion of the material, and pressing the applied cloth material with a heated metal plate to foam the foaming agent. Here, it is noted that the processed cloth means a cloth obtained by the present invention (so-called final product just obtained by the steps of the method according to the present invention) and includes clothes. And, the cloth material to be prepared means a starting material subjected to the method of the present invention and is, in other words, a virgin material (cloth) which is not yet subjected to any step (process) such as application (printing), pressing and/or heating according to the method of the present invention and may or may not be pre-dyed.

It is preferable that the method of producing a processed cloth of the present invention having the above components further includes a step of applying a second sizing agent containing a coloring agent on the cloth material. In this case, the second sizing agent may be applied on a region other than the region where the first sizing agent is applied, or the second sizing agent may be applied on a region where the first sizing agent is applied prior to the application of the first sizing agent.

It is preferable that the method of producing a processed cloth of the present invention having the above-mentioned components further includes a step of sublimation transfer printing to the cloth material. In this case, the method may further include the step of washing the pressed cloth material, and the washed cloth material may be pressed again by means of the metal plate together with the transfer paper on which a sublimable (sublimating or sublimation) ink is printed. Alternatively, the printed cloth material may be pressed with the metal plate together with a transfer paper on which a sublimable ink is printed.

Effect of the Invention

According to the present invention, a specific portion of a cloth material can be reliably and sufficiently foamed in a simple manner. Therefore, it is possible to form various concave-convex patterns on the processed cloth, or to achieve pleating with various expressions.

DETAILED DESCRIPTION OF THE INVENTION

Hereinafter, a producing process of a processed cloth according to a typical embodiment of the present invention will be described in detail with reference to the drawings. It is noted that the drawings are for conceptually explaining the present invention and, therefore, the dimensions, ratios, or numbers may be exaggerated or simplified for easy understanding, and the present invention is not limited to these drawings.

1. TYPICAL EMBODIMENTS

The method for producing a processed cloth according to the present embodiment includes the following steps:

(1) preparing a cloth material;

(2) applying (or printing) a sizing agent containing a foaming agent to the cloth material;

(3) pressing the cloth material after the application (or printing) with a heated metal plate to foam the foaming agent; and (4) washing the cloth material.

Each of the above steps will be described with reference to FIGS. 1 to 7. In this specification, a shirt is used as an example of the processed cloth to describe the above steps, and other types of processed cloths such as trousers can be produced by the producing method described herein.

(1) Preparation of a Cloth Material

Figure 1:
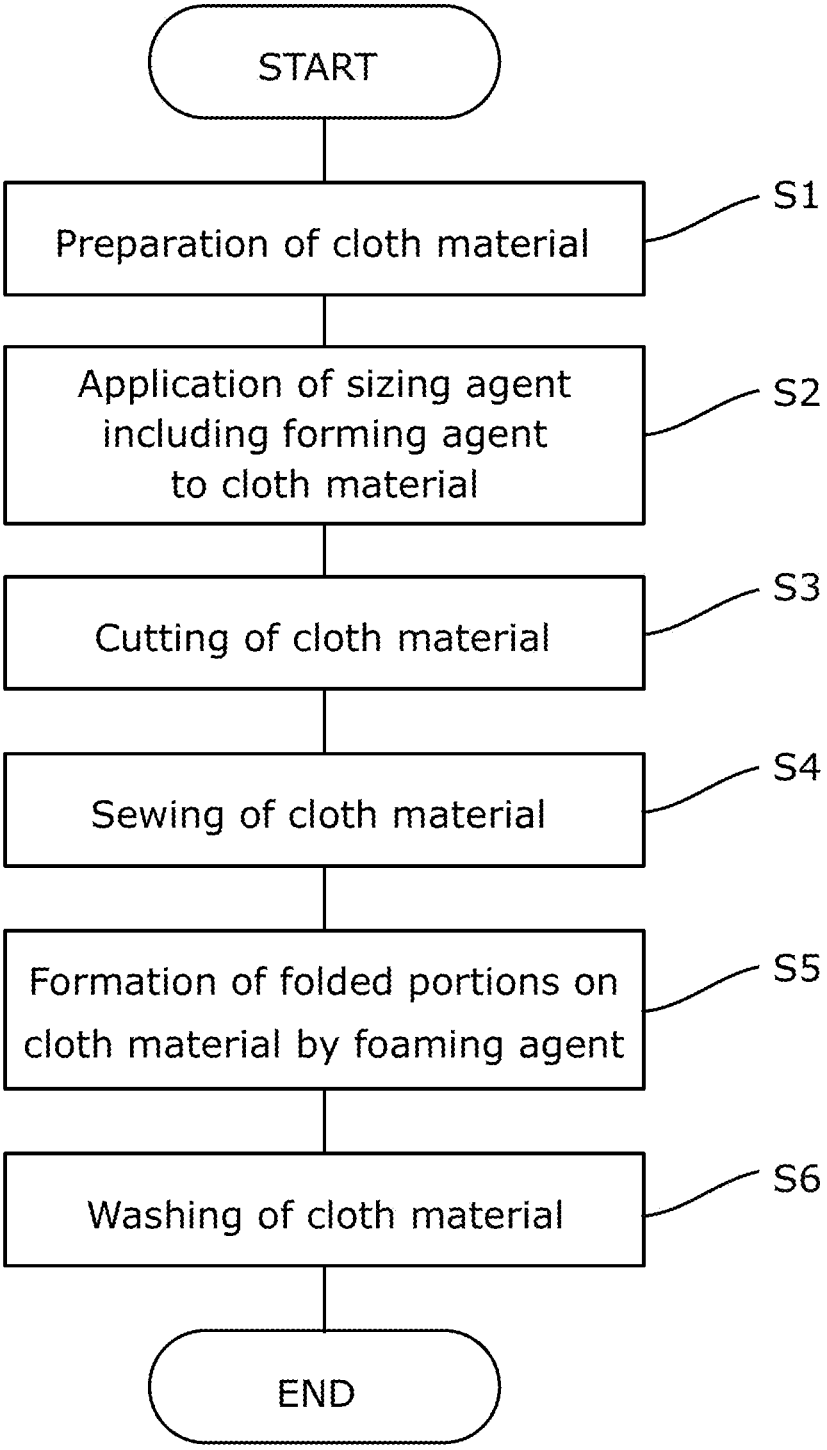
FIG. 1 is a flowchart illustrating steps of producing a processed cloth according to an embodiment of the present invention.

First, the cloth material 1 is prepared in step S1 of FIG. 1.

As the raw material of the cloth material 1, natural fibers and artificial fibers can be used, and in particular, a material cloth made of polyester or a material cloth made of polyester as a main material and mixed with wool or rayon can be suitably used. A woven fabric can be suitably used, but the present invention is not limited thereto. Further, as the cloth material, a pre-dyed cloth material or a post-dyed cloth material can be used.

(2) Application of a Sizing Agent

Next, a sizing agent containing a foaming agent is applied on at least a portion of the cloth material 1 in step S2. Such sizing agent corresponds to the first sizing agent in the claims.

For example, the foaming agent contains a foamable urethane resin as a main material, and when heated, the agent foams at a predetermined foaming rate. The sizing agent further includes a glue (paste), and as the glue to be used for the sizing agent, a natural glue (for example, starches, rubbers, or seaweeds), a synthetic glue (for example, polyvinyl alcohol), an emulsion glue (in O/W type, or W/O type), or a blend thereof can be appropriately used. The sizing agent may contain a coloring agent, and a pigment can be used as the coloring agent, for example.

Figure 6:
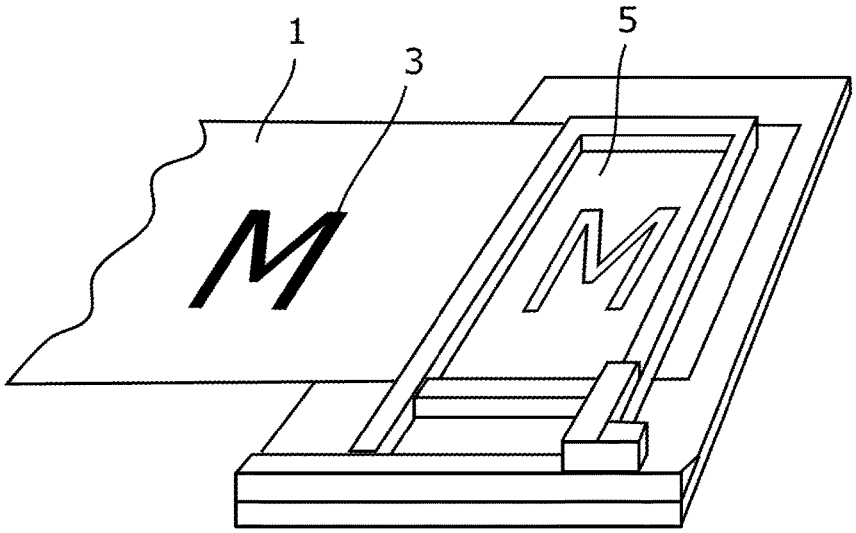
FIG. 6 is a schematic view illustratively showing the application of the sizing agent.

The application of the sizing agent can be carried out, for example, through a hand screen printing as shown in FIG. 6. In this case, an operator can use a squeegee or spatula to extrude the sizing agent from the screen 5 onto the cloth material 1 in order to form the sizing agent layer 3 on the cloth material 1.

Figure 2:
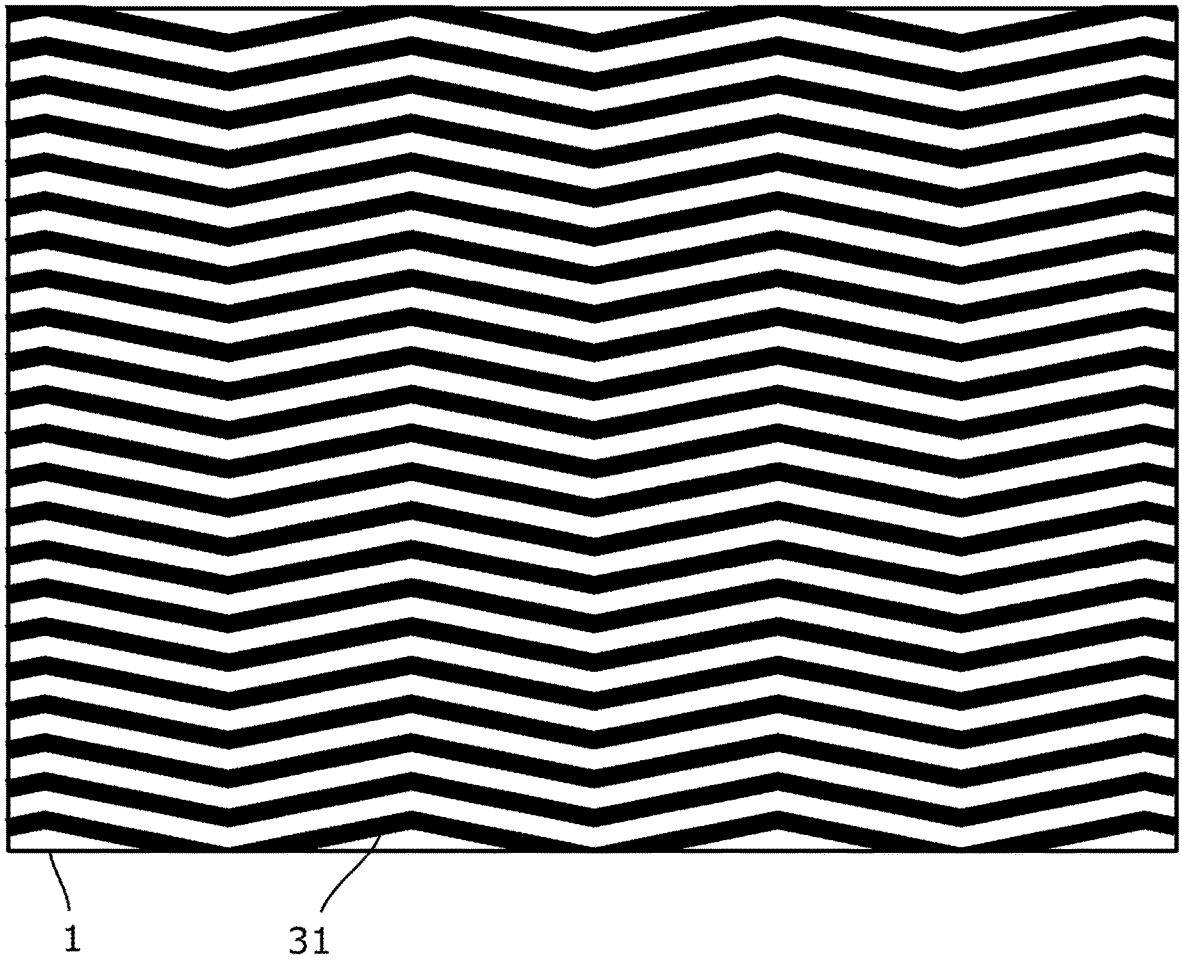
FIG. 2 is a schematic view showing an example of a cloth material after the application or printing.

As for the sizing agent layer, the sizing agent layer 3 can be formed in a partial region of the cloth material 1 as shown in FIG. 6, or the sizing agent layer 31 can be formed on the entire surface of the cloth material 1 as shown in FIG. 2. The application of the sizing agent can be carried out with hand tools or through various types of printing machines.

The cloth material 1 with the sizing agent applied is appropriately dried so as to have moisture content suitable for foaming. since the foaming agent foams excessively under the condition where the moisture content in the cloth material 1 is large, the cloth material 1 is dried preferably to such an extent that a moisture content measures 15% by mass or less of the whole cloth material 1 when measured on a condition where an electrode probe of the electric moisture meter is in contact with the applied surface (or the surface on the opposite side) of the cloth material 1. In order to obtain better foaming performance, it is more preferable that the moisture content of the cloth material 1 measures between 5% by mass and 15% by mass. An example of an electric moisture meter is an electric moisture meter MR-200II available from SANKO ELECTRONIC LABORATORY CO., LTD.

Figure 3A:
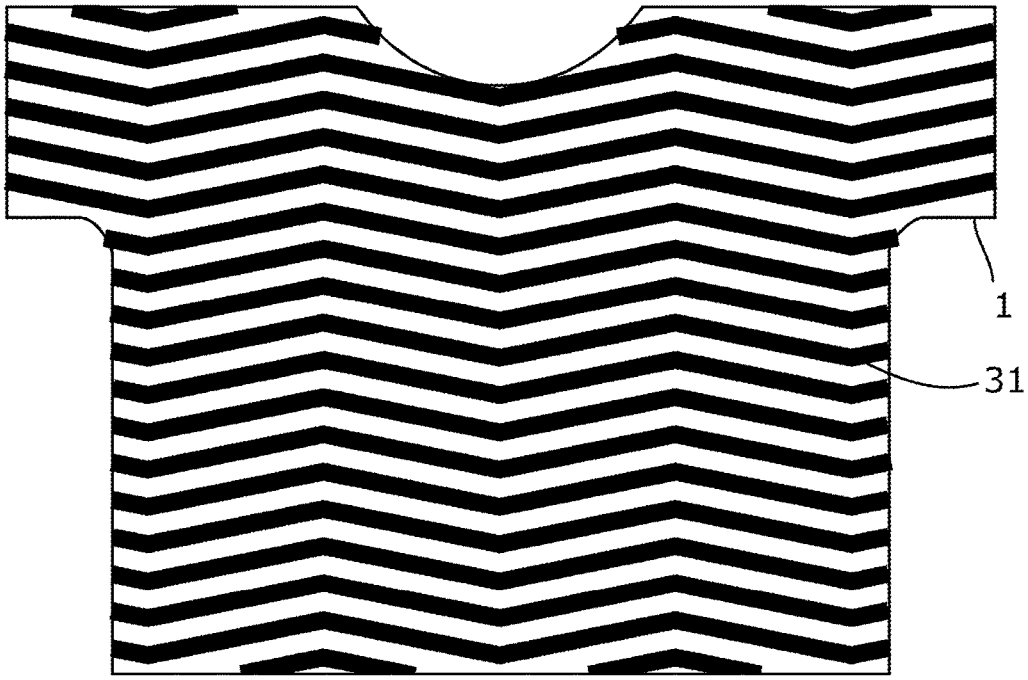
FIGS. 3(*a*) and 3(*b*) are schematic views showing an example of a cloth material after the cutting.
Figure 3B:
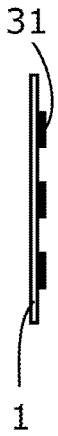

After the application of the sizing agent, the cloth material 1 is cut according to a predetermined pattern in step S3, as illustrated in FIGS. 3(*a*) and 3(*b*), and then the cut cloth materials 1 are sewn in step S4.

(3) Foaming by Heating

Figure 7A:
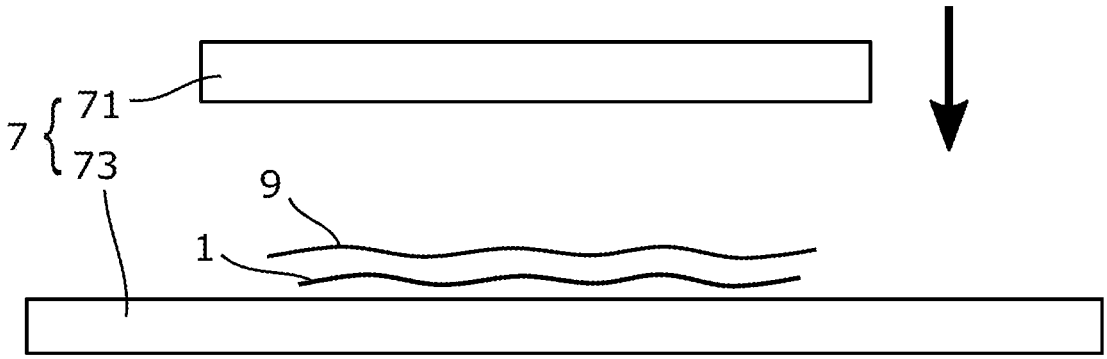
FIGS. 7(*a*) and 7(*b*) are schematic views illustratively showing the pressing.
Figure 7B:
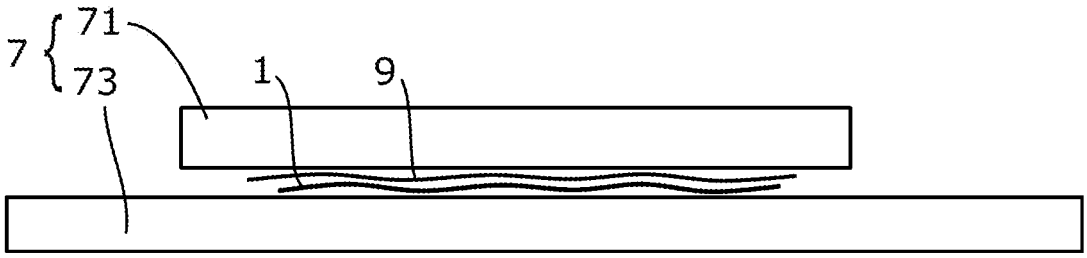
Figure 8A:
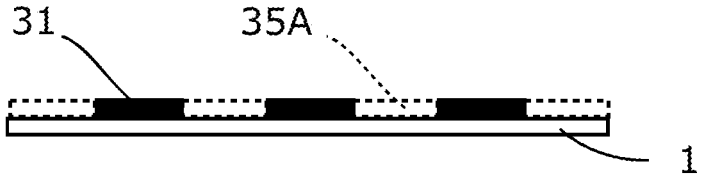
FIGS. 8(*a*), 8(*b*), 8(*c*) and 8(*d*) are schematic diagrams of a producing process of a processed cloth according to a modified example 1 of the present embodiment.
Figure 8B:
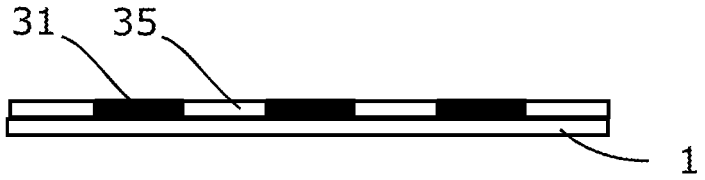
Figure 8C:
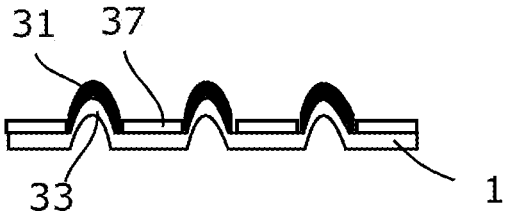
Figure 8D:
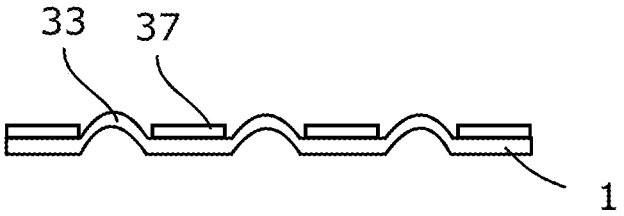
Figure 9A:
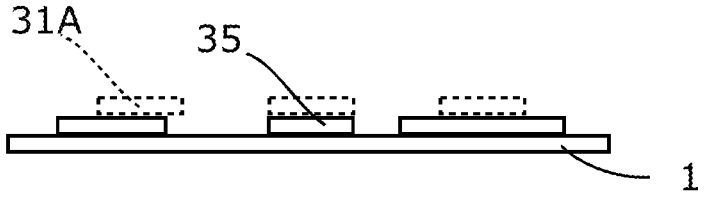
FIGS. 9(*a*), 9(*b*), 9(*c*) and 9(*d*) are schematic diagrams of a producing process of a processed cloth according to a modified example 2 of the present embodiment.
Figure 9B:
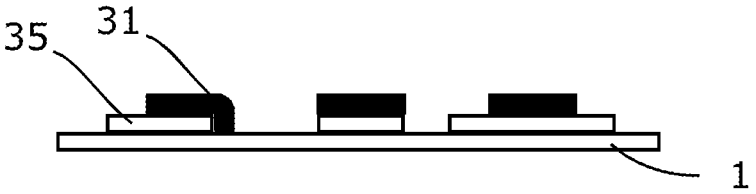
Figure 9C:
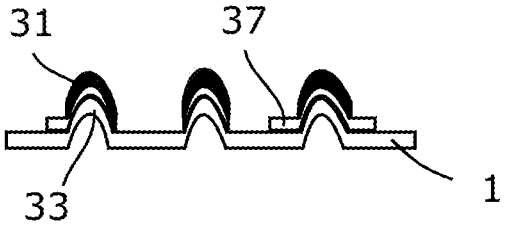
Figure 9D:
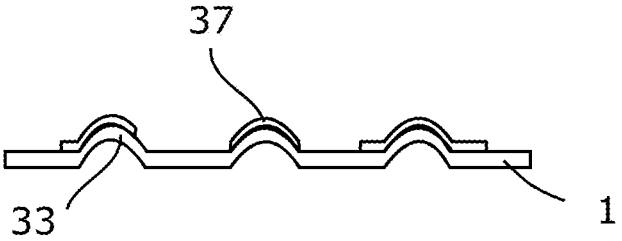
Figure 10A:
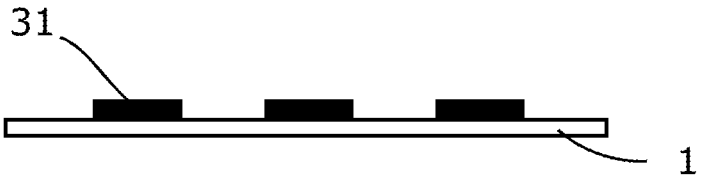
FIGS. 10(*a*), 10(*b*), 10(*c*) and 10(*d*) are schematic diagrams of a producing process of a processed cloth according to a modified example 3 of the present embodiment.
Figure 10B:
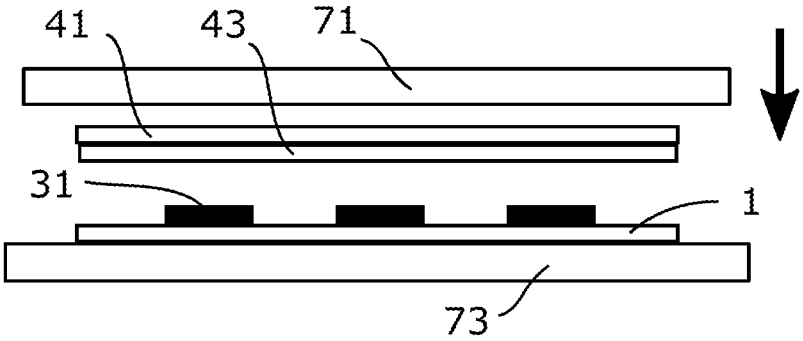
Figure 10C:
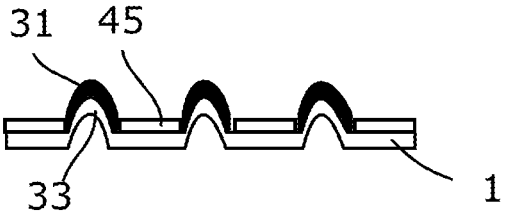
Figure 10D:
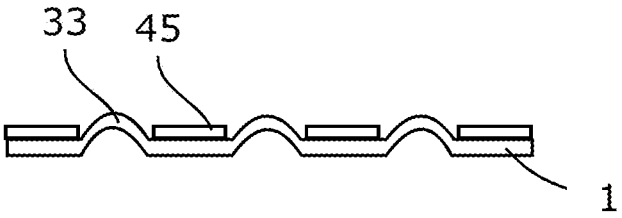
Figure 11A:
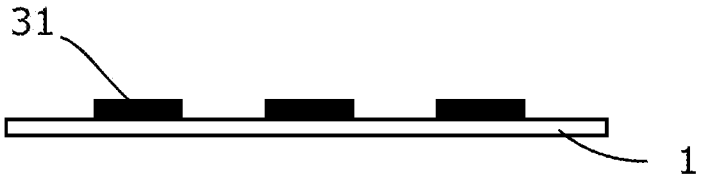
FIGS. 11(*a*), 11(*b*), 11(*c*), 11(*d*) and 11(*e*) are schematic diagrams of a producing process of a processed cloth according to a modified example 4 of the present embodiment.
Figure 11B:
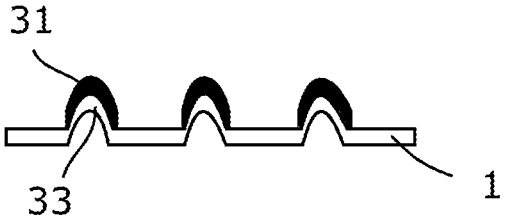
Figure 11C:
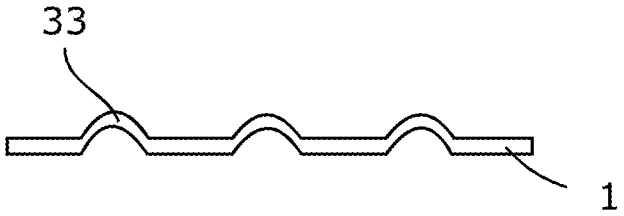
Figure 11D:
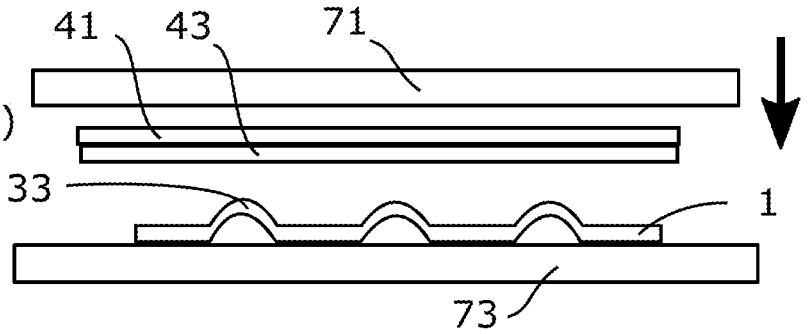
Figure 11E:
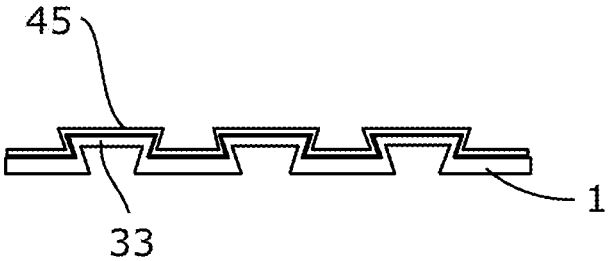

The applied cloth material (or sewn fabric) 1 is pressed with a heated metal plate to foam the foaming agent in step S5. As shown in FIG. 7(*a*), the cloth material 1 is set between the metal iron 71 and the table 73 in the press machine 7, and then the heated metal iron 71 is pressed against the table 73 as shown in FIG. 7(*b*). During this step, the foaming agent included in the sizing agent layer 31 is foamed. In order to prevent the cloth material 1 from being damaged by heat, the release paper 9 may be interposed between the cloth material 1 and the metal iron 71.

Figure 4A:
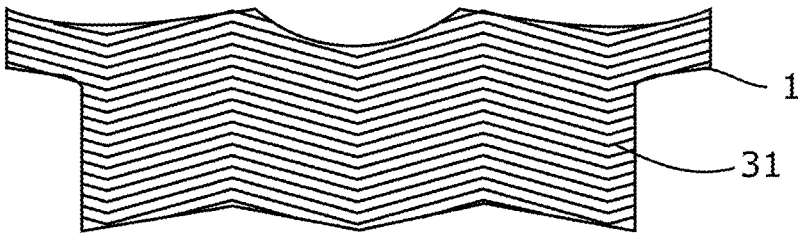
FIGS. 4(*a*) and 4(*b*) are schematic views showing an example of a cloth material after the pressing.
Figure 4B:
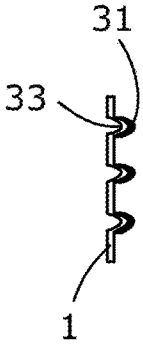

Foaming of the foaming agent by heating causes a change of the form of the cloth material 1 from the flat shape (e.g., see FIGS. 3(*a*) and 3(*b*)) to the concave-convex (or uneven) shape having the folded portions (or pleats) 33 (see FIGS. 4(*a*) and 4(*b*)). As a result, the cloth material 1 shrinks as a whole.

The press conditions are preferably set as follows from the viewpoint of reliable foaming and prevention of damage to the cloth material:

Pressure: 1 to 10 kg/10 $cm^2$

Pressing duration: 10-120 seconds

Temperature of metal plate: 190-220° C.

The following conditions are more preferable:

Pressure: 2 to 6 kg/10 $cm^2$

Pressing duration: 20 to 40 seconds

Temperature of metal plate: 210-220° C.

As a processing machine for this step, a flat thermal transfer machine can be suitably used, and a flat type sublimation transfer press HSP-2210 available from HASHIMA CO., LTD. can be exemplified.

(4) Washing

Figure 5A:
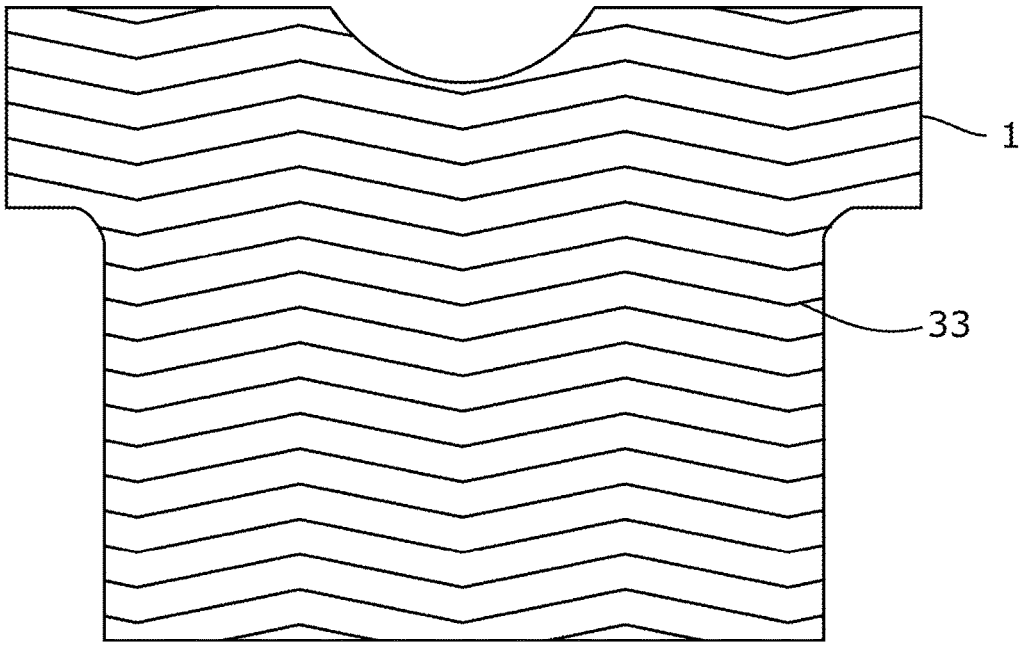
FIGS. 5(*a*) and 5(*b*) are schematic views showing an example of a cloth material after the washing.
Figure 5B:
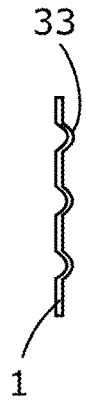

The cloth material 1 is cleaned to wash out the sizing agent in step S6. For example, the cloth material 1 may be washed with water, rinsed, span for removal of water, and then dried after the return to the shape of the cloth material. As shown in FIGS. 5(*a*) and 5(*b*), the cloth material 1 holding the folded portions 33, or processed cloth, can be obtained. It should be noted that if the processed cloth constitutes a structural body requiring a certain strength, such as a chair or a shade of a lighting equipment, the foamed foaming agent can remain adhered to the material cloth in order to ensure the strength. In such a case, the washing step may be omitted.

According to the producing method of the processed cloth of the present embodiment, a specific portion of the cloth material 1 can be reliably and sufficiently foamed in a simple manner. Therefore, it is possible to form various concave-convex patterns on cloth materials.

2. MODIFIED EXAMPLE 1

Referring to FIGS. 8(*a*) to 8(*d*), a method of producing a processed cloth according to Modified example 1 of the present embodiment will be described.

In Modified example 1 and Modified example 2, in addition to the sizing agent (first sizing agent) containing the foaming agent, the sizing agent (second sizing agent) containing the coloring agent is also applied to the cloth material. In Modified example 1, after applying or printing of the sizing agent containing the foaming agent, the sizing agent containing the coloring agent is applied on the cloth material. The order of applications of these sizing agents can be changed as long as the application areas of these sizing agents do not overlap with each other.

More specifically, after preparing or the cloth material 1 a sizing agent containing a foaming agent is applied on the cloth material 1 to form a sizing agent layer 31 on the cloth material 1 as shown in FIG. 8(*a*).

As shown in FIG. 8(*b*), a sizing agent containing a colorant is applied or printed on a region 35A (see FIG. 8(*a*)) other than a region for the sizing agent layer 31, to form a sizing agent layer 35 on the cloth material 1. The sizing agent layer 35 can overlap the sizing agent layer 31, but it should be noted that sufficient color development might not be ensured in the overlapping region of the sizing agent layer 35 and the sizing agent layer 31, and that such layer overlapping might cause dyeing unevenness or staining. The cloth material 1 including both the sizing agents is appropriately dried so as to have a moisture content of 15% by mass or less as a whole of the cloth material 1 through the above-described measurement method.

A pigment or a dye can be used as the colorant, and a pigment is used here. Examples of pigments include titanium oxide for white color, carbon black for black color, and organic pigments (for example, azo pigments) for other colors. A plurality of types of pigments can be used depending on the design of the processed cloth.

The sizing agent contains a binder for fixing the pigment to the cloth material 1, and examples of such binder are a self-crosslinking type acrylic resin, a urethane resin, and a latex resin.

The sizing agent further includes a glue. As the glue, a natural glue (for example, starches, rubbers, or seaweeds), a synthetic glue (for example, polyvinyl alcohol), an emulsion glue (in O/W type, or W/O type), or a blend thereof is appropriately used as described above.

Once the cloth material 1 after the application is sewn and the sewn cloth material 1 is pressed with a heated metal plate, the foaming agent is foamed and the coloring agent is fixed to the cloth material 1. As a result, as shown in FIG. 8(*c*), the folded portions 33 and the pattern 37 are formed on the cloth material 1 in a manner where they do not overlap each other. The press condition described in the present embodiment can be used in Modified example 1.

The cloth material 1 is washed and, as shown in FIG. 8(*d*), the sizing agent is removed from the cloth material 1 while the folded portions 33 and the patterns 37 remain.

In Modified example 1, a sizing agent containing a coloring agent is applied in a region 35A other than the region 31 where the sizing agent containing the foaming agent is printed so as not to overlap with the region 31 for the sizing agent containing the foaming agent. Thus, the formation of the folded portions 33 by foaming and the formation of the pattern 37 can be carried out at the same time while ensuring sufficient foaming performance and coloring performance.

3. MODIFIED EXAMPLE 2

Referring to FIG. 9, a method of producing a processed cloth according to Modified example 2 of the present embodiment will be described.

In Modified example 2, the application of the sizing agent containing the coloring agent is carried out prior to the application of the sizing agent containing the foaming agent. The sizing agent containing the coloring agent is applied on all or part of the region where the sizing agent containing the foaming agent is applied.

More specifically, after the cloth material 1 is prepared, a sizing agent containing a coloring agent is applied on the cloth material 1 to form a sizing agent layer 35 on the cloth material 1 as shown in FIG. 9(*a*). In this example, the sizing agent containing the coloring agent is applied so that all or a part of the sizing agent layer 35 overlaps with the tentative region 31A where the sizing agent containing the foaming agent is to be applied. The same coloring agent as in Modified example 1 can be used in this example.

As shown in FIG. 9(*b*), a sizing agent containing a foaming agent is applied on the cloth material 1 to form a sizing agent layer 31. For appropriate foaming, the cloth material 1 with both the sizing agents is dried so that the moisture content of the cloth material 1 measures 15% by mass or less of the whole cloth material 1. The measurement method of the moisture content of the cloth material 1 is described above in the present embodiment and Modified example 1.

The applied cloth material 1 is pressed with a heated metal plate. Then, the foaming agent foams and the coloring agent is fixed to the cloth material 1. Considering the overlap of the sizing agent layers 31 and 35, it is preferable to set the pressurizing force of the press machine 7 to be, for example, 5 to 6 kg/10 $cm^2$ which is a higher part in the range of the pressurizing force in the present embodiment, in order to reliably carry out coloring and foaming.

As a result of the pressing, folded portions 33 is formed in the cloth material 1, and a pattern 37 is formed in all or part of the folded portions 33 as shown in FIG. 9(*c*). Once the cloth material 1 is washed, the sizing agent is removed from the cloth material 1 to expose the pattern 37 as shown in FIG. 9(*d*).

According to the producing method of the processed cloth according to Modified example 2, it is possible to reliably form a vivid pattern on the folded portions 33. The fabric obtained by Modified example 2 has excellent coloring development as compared with a fabric obtained by applying a sizing agent containing both of the foaming agent and the coloring agent on a cloth material.

4. MODIFIED EXAMPLE 3

Referring to FIGS. 10(*a*) to 10(*d*), a method of producing a processed cloth according to Modified example 3 of the present embodiment will be described.

Modified examples 3 and 4 include a dyeing step by sublimation transfer. In Modified example 3, during the formation of the folded portion by foaming, the region other than the folded portion is dyed by sublimation transfer.

More specifically, after preparing the cloth material 1, a sizing agent containing a foaming agent is applied on the cloth material 1 to form a sizing agent layer 31 on the cloth material 1 as shown in FIG. 10(*a*). Preferably moisture content in the sizing agent layer 31 measures, for example, 5 to 8% by mass which is a smaller part in the range of the moisture content described above in the present embodiment. Thus, it is possible to prevent excessive foaming resulting from supply of excessive moisture to the foaming agent through evaporation of the sublimable ink by heating.

Further, a transfer paper 41 is prepared, and on the transfer paper 41 a sublimable ink is printed to form an ink layer 43.

In this example, the ink layer 43 substantially covers the entire surface of the cloth material 1 as shown in FIG. 10(*b*), but the ink layer 43 can be disposed so as not to overlap with the sizing agent layer 31 on the cloth material 1.

The cloth material 1 is pressed together with the transfer paper 41 with the thermal transfer machine 7, i.e., between the metal iron 71 and the table 73. Then, as shown in FIG. 10(*c*), the folded portions 33 is formed by the foaming of the foaming agent. Further, the cloth material 1 is dyed by the evaporation of the sublimable ink to form a pattern 45 in the region other than the folded portions 33 on the cloth material 1. In order to reliably carry out foaming and dyeing, it is preferable to set the pressure range of the thermal transfer machine to be, for example, 5 to 6 kg/10 $cm^2$ which is a higher part in the ranges of the pressure in the present embodiment, and set the pressing duration to be, for example, 30 to 40 seconds which is relatively longer for the pressing duration used in the present embodiment.

Once the cloth material 1 is washed, the sizing agent layer 31 is removed from the cloth material 1 while the folded portions 33 and the pattern 45 remain in the cloth material 1, as shown in FIG. 10(*d*).

In Modified example 3, the cloth material 1 with the sizing agent containing the foaming agent is pressed together with the transfer paper 41 on which the sublimable ink is printed. Thus, the formation of the folded portions 33 by foaming and the formation of the pattern 45 by dyeing in the region other than the folded portions 33 can be carried out simultaneously. In addition, sufficient foaming performance and coloring performance can be ensured.

5. MODIFIED EXAMPLE 4

Referring to FIGS. 11(*a*) to 11(*e*), a method of producing a processed cloth according to Modified example 4 of the present embodiment will be described.

In Modified example 4, a dyeing step by sublimation transfer is added to the steps described above in the present embodiment.

More specifically, after preparing of the cloth material 1, a sizing agent containing a foaming agent is applied on the cloth material 1 to form a sizing agent layer 31 on the cloth material 1 as shown in FIG. 11(*a*). Then, the pressing of the cloth material 1 with a heated metal plate causes the foaming of the foaming agent to form the folded portions 33 in the cloth material 1 as shown in FIG. 11(*b*). Once the cloth material 1 is washed, the sizing agent is removed from the cloth material 1 while the folded portions 33 remain, as shown in FIG. 11(*c*).

A transfer paper 41 is further prepared on which sublimable ink is printed to form an ink layer 43. The ink layer 43 can cover substantially the entire surface of the cloth material 1.

As shown in FIG. 11(*d*), the cloth material 1 is pressed together with the transfer paper 41 with the thermal transfer machine 7 or between the metal iron 71 and the table 73. Then, as shown in FIG. 11(*e*), the folded portions 33 are deformed flat by the pressing of the metal iron 71, and the pattern 45 is transferred to the folded portions 33 by the evaporation of the sublimable ink. From the viewpoint of reliable sublimation transfer, it is preferable to set the pressure range of the thermal transfer machine to between 1 and 10 kg/10 $cm^2$, the pressing duration to between 30 and 120 seconds, and the heat temperature of the metal plate to between 190 and 220° C. More preferably, from the viewpoint of adequate transfer performance, the pressure range is set between 5 and 6 kg/10 $cm^2$, the pressing duration between 50 and 70 seconds, and the heat temperature of the metal plate between 210 and 220° C.

According to the producing method of the processed cloth in Modified example 4, it is possible to impart a characteristic flat shape to the folded portions 33, as well as to impart a vivid pattern 45 to the cloth material 1 including the folded portion 33. This makes it possible to form various concave-convex patterns on the cloth material, or to form pleats with various expressions.

The producing methods of the processed cloth according to the above-described Modified examples 1 to 4 can be appropriately combined. For example, a combination of Modified examples 1 and 2, a combination of Modified examples 2 and 3, a combination of Modified examples 3 and 4, and a combination of Modified examples 1 and 4 are possible. Overlapping steps can be omitted from the above combination of the modified examples.

The representative embodiments of the present invention have been described above, but the present invention is not limited to these embodiments, and various modifications are possible, and all such modifications are included in the technical scope of the present invention.

For example, clothing such as neckties, bags, curtains, chairs, and shades of lighting equipment may be produced as the processed cloth.

In the preferable mode of the present invention, it is possible to achieve pleating with various and complicated expressions, especially by a method for producing a processed cloth, comprising the steps of:

preparing a cloth material, applying a first sizing agent containing a foaming agent on at least a portion of the material, pressing the applied cloth material by means of a heated metal plate to foam the foaming agent and, at the same time, carry out a sublimation transfer printing to the cloth material, washing the pressed cloth material, and pressing the washed cloth material again together with a transfer paper on which a sublimable ink is printed by means of the heated plate.

EXPLANATION OF NUMERALS

1 . . . Cloth material
3 . . . Sizing agent layer
5 . . . Screen
7 . . . Pressing machine (thermal transfer machine)
31 . . . A sizing layer containing a foaming agent
33 . . . Folded portion
35 . . . Sizing agent layer containing colorant
37 . . . Pattern
41 . . . Transfer paper
43 . . . Ink layer
45 . . . Pattern

The invention claimed is:

1. A method for producing a processed cloth, comprising the steps of:

preparing a cloth material, printing, without a transfer sheet, a first sizing agent containing a foaming agent on at least a portion of the cloth material, pressing the applied cloth material with a heated metal plate to foam the foaming agent to form folded portions in the cloth material, washing the cloth material after pressing to remove the sizing agent, and pressing again, by means of the metal plate, the cloth material after the washing together with a transfer paper on which a sublimable ink is printed to carry out sublimation transfer to the folded portions of the cloth material.

2. The method for producing a processed cloth in accordance with claim 1, further comprising a step of applying a second sizing agent containing a coloring agent on the cloth material.

3. The method for producing a processed cloth in accordance with claim 2, wherein the second sizing agent is applied on a region other than a region where the first sizing agent is printed.

4. The method for producing a processed cloth in accordance with claim 2, wherein, prior to printing of the first sizing agent, the second sizing agent is applied on the region where the first sizing agent is to be printed.

* * * * *